US005941116A

United States Patent [19]

Kunze

[11] Patent Number: 5,941,116

[45] Date of Patent: Aug. 24, 1999

[54] BENDING MACHINE PROVIDED WITH A BLANK HOLDER HAVING PROGRAMMABLE LENGTH

[75] Inventor: Wolfgang Kunze, Leonding, Austria

[73] Assignee: Salvagnini Italia S.p.A., Sarego (Vicenza), Italy

[21] Appl. No.: 08/937,650

[22] Filed: Sep. 25, 1997

[30] Foreign Application Priority Data

Oct. 3, 1996 [IT] Italy ..... MI96A2034

[51] Int. Cl.[6] ..... B21D 5/04

[52] U.S. Cl. ..... 72/306; 72/322

[58] Field of Search ..... 72/478, 319, 323, 72/306, 322

[56] References Cited

U.S. PATENT DOCUMENTS

| | | | |
|---|---|---|---|
| 4,660,402 | 4/1987 | Hongo | 72/478 |
| 4,722,214 | 2/1988 | Hayashi | 72/319 |
| 4,930,332 | 6/1990 | Hongo | 72/478 |
| 5,313,814 | 5/1994 | Yamamoto | 72/323 |
| 5,642,639 | 7/1997 | Codatto | 72/478 |

FOREIGN PATENT DOCUMENTS

| | | | |
|---|---|---|---|
| 0 105 091 | 4/1984 | European Pat. Off. . | |
| 0 274 159 | 7/1988 | European Pat. Off. . | |
| 0 577 068 | 1/1994 | European Pat. Off. . | |
| 0 662 996 | 11/1995 | European Pat. Off. . | |
| 0 694 346 | 1/1996 | European Pat. Off. . | |
| 41020 | 2/1992 | Japan | 72/478 |
| 212446 | 8/1993 | Japan | 72/478 |

*Primary Examiner*—Daniel C. Crane
*Attorney, Agent, or Firm*—Nixon & Vanderhye, P.C.

[57] ABSTRACT

A bending machine for the production of metal sheet panels having bent edges comprises a blank holder having programmable length provided with blank holder composition segments each formed by a main slidable segment and by an auxiliary segment movably supported by the main segment and operatively connected to actuators capable of displacing it from a work position wherein an active edge thereof is aligned with continuity with an active edge of the main segment to an at rest position wherein it is capable of penetrating inside a cavity obtained in one side of a segment that is adjacent to it on the opposite side of the main coupled segment.

12 Claims, 7 Drawing Sheets

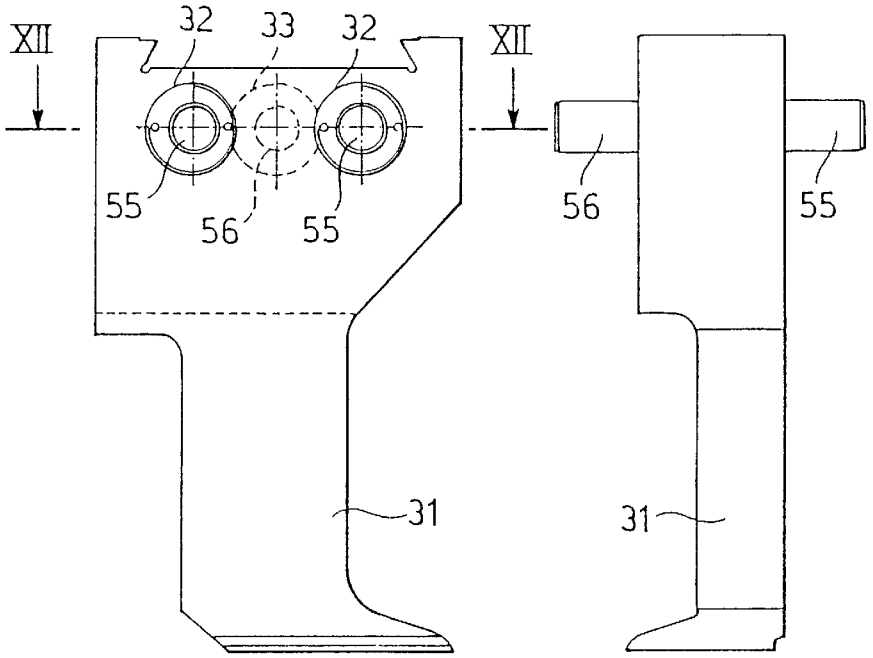
Fig.10
Fig.11
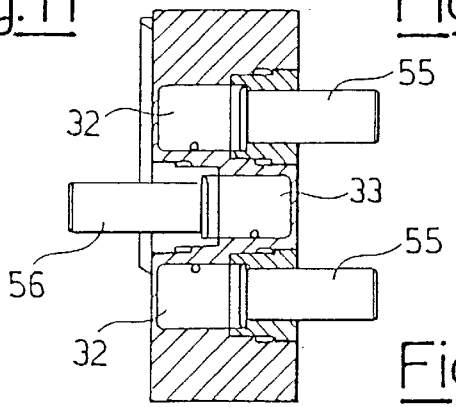
Fig.12
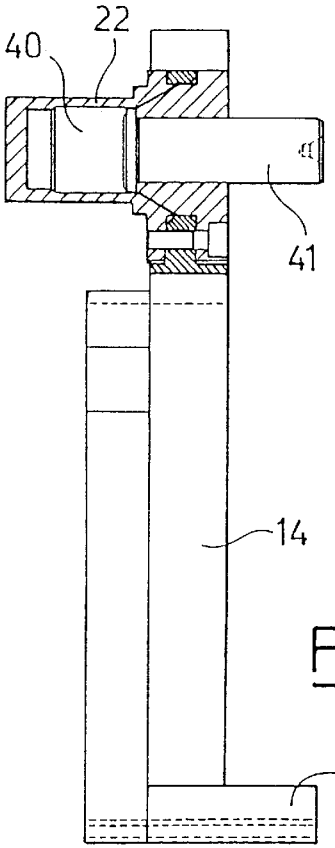
Fig.5
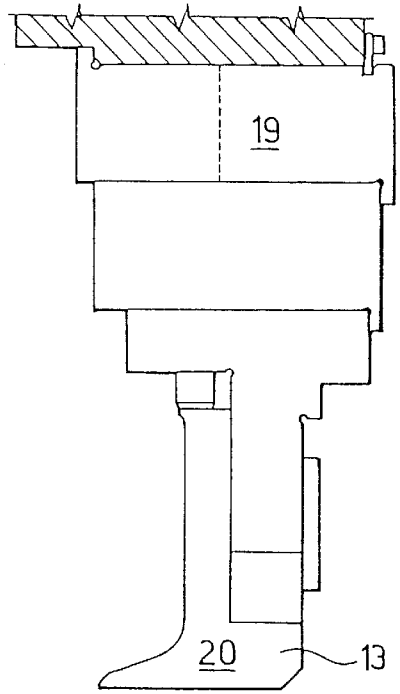
Fig.4

BENDING MACHINE PROVIDED WITH A BLANK HOLDER HAVING PROGRAMMABLE LENGTH

This application is based on application No. MI96 A 002034 filed in Italy, the content of which is incorporated hereinto by reference.

BACKGROUND

I. Field of the Invention

The present invention relates to a bending machine provided with a blank holder having programmable length.

II. Related Art and Other Considerations

Machines are known for bending metals sheets, called bending machines, that are used for the production of metal sheet panels of a substantially rectangular shape having bent edges. The panels are used, for example, in the manufacture of casings for home appliances, metal furniture, shelves and the like.

Generally, the known bending machines comprise a pair of opposite bending blades, one upper and one lower, a fixed bending counterblade and a blank holder capable of interacting.

The bending blades are supported by arms of a structure, preferably in the shape of a "C", so as to allow movements driven by special mechanisms. The "C"-shaped structure is capable of translating vertically so that one or the other blade is brought to engagement with an edge of the metal sheet to be bent so as to execute a bend upward or downward.

The counterblade is integral with the base of the machine and on it is placed the metal sheet to be bent. It is in a single piece and it has a horizontal edge, against which one of the bending blades urges the metal sheet so as to bend it downward or upward.

The blank holder is used to keep the metal sheet in adherence with the counterblade during the bending operation so that the bend will be straight and with a small radius of curvature. The active edge of the blank holder, above the edge of the counterblade, co-operates with the blade used for bending upward or downward the metal sheet held tight between the blank holder and the counterblade.

In some known bending machines, the blank holder is in a single piece. Such machines can bend a metal sheet only along sides that not intersect one another.

On the other hand, in order to produce panels bent along sides that do intersect one another and have any length, bending machines are used provided with a blank holder having a length that is variable with continuity or with very small steps.

The U.S. Pat. No. 4,532,792 describes a device for adjusting the length of a blank holder comprising a group of first blank holder segments and a plurality of second thin blank holder segments. The first blank holder segments are slidable along a first horizontal axis having a direction transversal with respect to the blank holder, while the second blank holder segments are mounted in an invertible manner in the centre of the group of first blank holder segments. The second blank holder segments have a very small width, substantially less than that of the first blank holder segments. A finger-type driving mechanism causes the first blank holder segments to slide along the horizontal axis and a reverse mechanism drives the reversal of a predetermined number of second blank holder segments making them rotate round a second horizontal axis through an angle of about 180°. In that way, the surplus second blank holder segments are brought to a position at rest and the first and the second blank holder segments that have remained in a work position can be brought closer together so as to restore the continuity of the active edge of the blank holder having the desired length.

This known device has the disadvantage that the second blank holder segments, rotating, occupy part of the space surrounding the blank holder. They therefore move to an area that is generally occupied by a tool-change device or that must remain available for such device. It happens in fact that the sharp edges of the counterblade and of the blank holder do not always meet the requirements of the bending operation. It is therefore sometimes necessary to apply extensions with more suitable profiles. The device that handles such extensions (tool change) and the extensions themselves, especially those destined for the blank holder, given their requirement of rigidity and accuracy and in view of the limited time available for the change, must be quite close to the bending edges and would therefore interfere with any element that were to protrude from the blank holder.

The device of the U.S. Pat. No. 4,532,792 does not allow this constraint to be observed because the second blank holder segments, when they are in an at rest position, occupy precisely a part of the area reserved for the tool-change device.

An object of the present invention is a bending machine provided with a blank holder having programmable length to leave the surrounding space free and not interfere with the tool-change device.

SUMMARY

The above-mentioned object is achieved, according to the invention, by a bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by vertically displaceable guide means, characterized in that said blank holder also comprises blank holder composition segments each formed by a main slidable segment and by an auxiliary segment coupled together, said auxiliary segment being movably supported by said main segment and being operatively connected to actuator means capable of displacing it from a work position, wherein an active edge thereof is aligned with continuity with an active edge of said main segment, to an at rest position wherein said auxiliary segment is capable of penetrating inside a cavity obtained in one side of a segment that is adjacent to it on the opposite side of said main coupled segment.

One of the main advantages of the bending machine according to the invention consists in the fact that the auxiliary blank holder segment or the auxiliary blank holder segments execute very small displacements in order to move from the work position to the at rest position. In particular they execute displacements such that the auxiliary blank holder segment (or segments) do not protrude from their original position. They therefore leave the space surrounding the blank holder completely free.

Another advantage is represented by the fact that, in the production of box-like panels, having that is the edges bent toward the inside of the panel, it is possible to adjust the length of the blank holder in relation to the length of a long side of the panel and to extend or contract the blank holder during the operation of the machine so as to allow its ends to introduce themselves under the edges of the metal sheet that have already been bent and then to extract themselves, at the start and at the end, respectively, of the bending operation of a long side of the metal sheet.

Lastly, in the bending machine according to the invention, contractions and extensions of the blank holder are made in a simple, safe and accurate manner without jeopardising the continuity of its active edge or altering its resistance to the bending forces.

BRIEF DESCRIPTION OF THE DRAWINGS

Features and advantages of the invention will now be illustrated with reference to an embodiment represented as a non-limiting example in the enclosed drawings, wherein:

FIG. 4 is a left-hand side view, partially sectioned, of the centre segment of FIG. 3;

FIG. 5 is a front view, partially sectioned, of the expansion segment of FIG. 3;

FIG. 10 is a front view of an external segment of the blank holder of FIG. 2;

FIG. 11 is a right-hand side view of the external segment of FIG. 10;

FIG. 12 is a cross-sectional view taken along the plane XII—XII of FIG. 11;

DETAILED DESCRIPTION OF THE DRAWINGS

Figure 1:
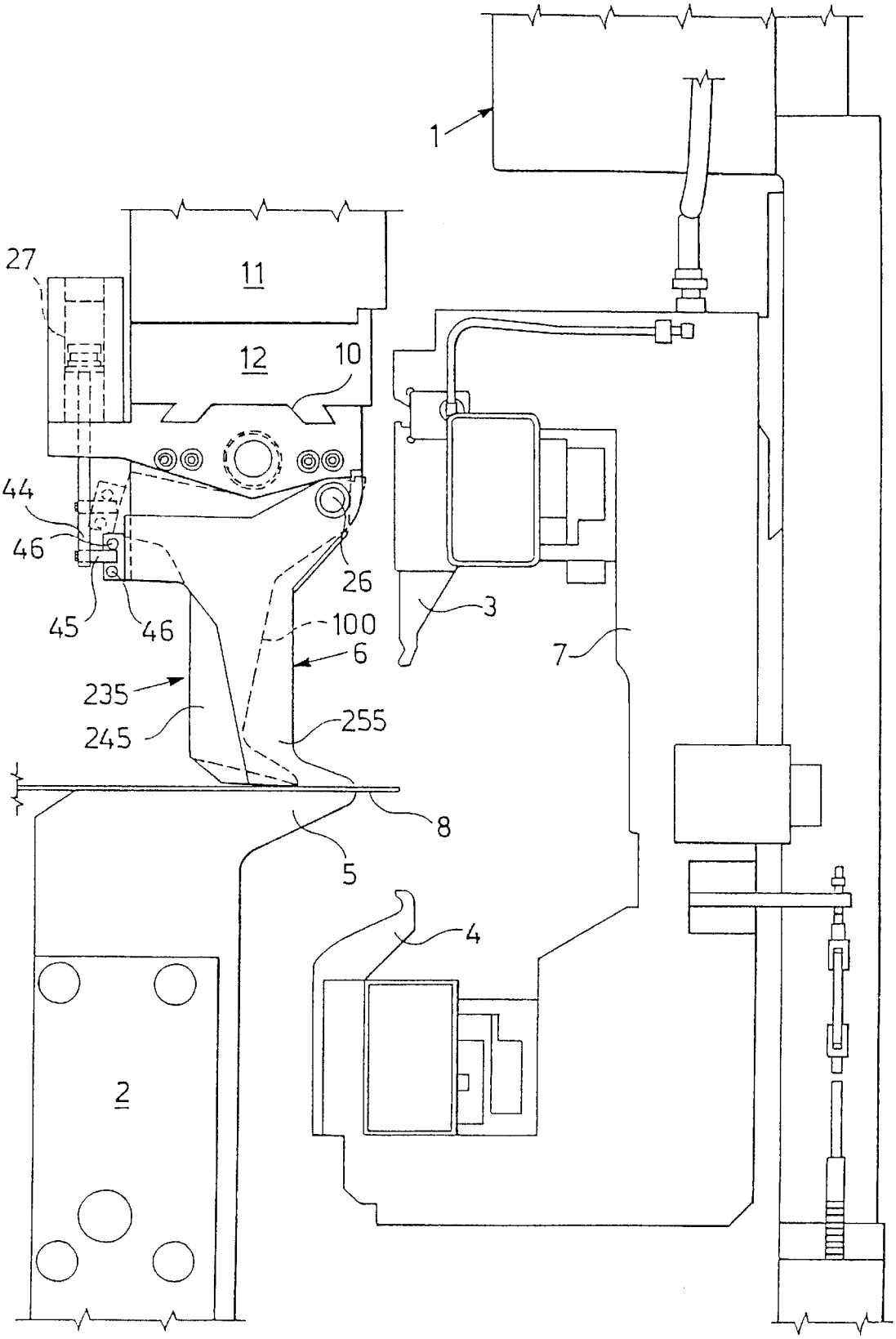
FIG. 1 is a schematic, lateral view of a bending machine provided with a blank holder having programmable length, made according to the invention.

FIG. 1 shows a bending machine comprising a fixed chassis 1 having a base 2, that rests on the ground, a pair of opposite blades 3 and 4, upper and lower, a counterblade 5, fastened to the base 2, and a blank holder 6 having programmable length.

The opposite blades 3 and 4 are mounted to oscillate, (by means of known mechanisms, and therefore not shown), in a "C"-shaped blade holder 7, slidably supported in the chassis 1. The blade holder 7 is driven to translate vertically by hydraulic cylinders, not shown, because they are known, to drive the blades 3 and 4 to bend, upward and downward, respectively, one edge of a metal sheet 8 with a polygonal shape that is held tightly between the counterblade 5 and the blank holder 6.

Figure 2:
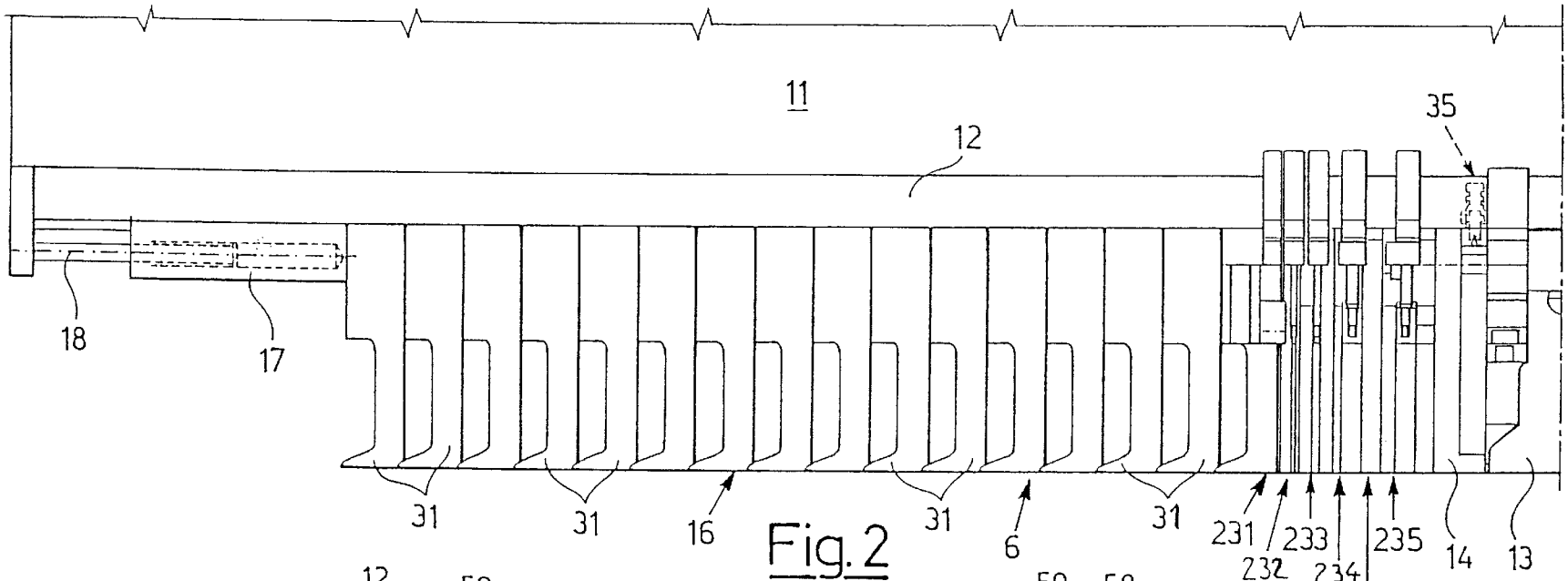
FIG. 2 is a front view of one half of the blank holder of the bending machine of FIG. 1.
Figure 14:
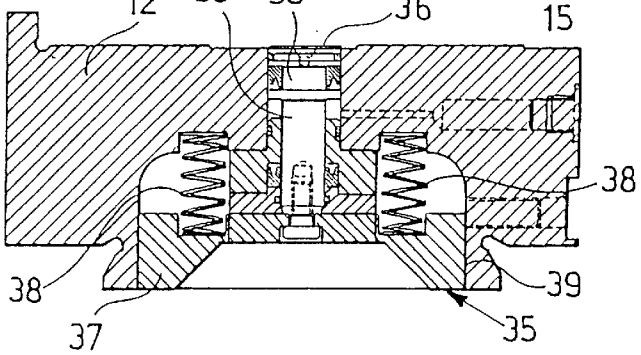
FIG. 14 shows the safety device of FIG. 13 in an inoperative condition.
Figure 13:
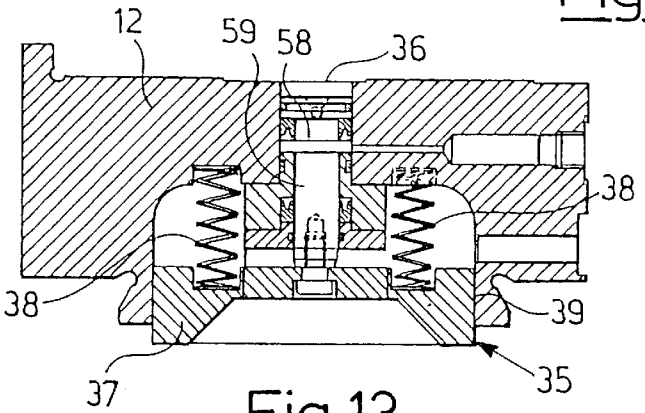
FIG. 13 is a cross-sectional view of a safety device of the blank holder of FIG. 2, in an operative condition.
Figure 3:
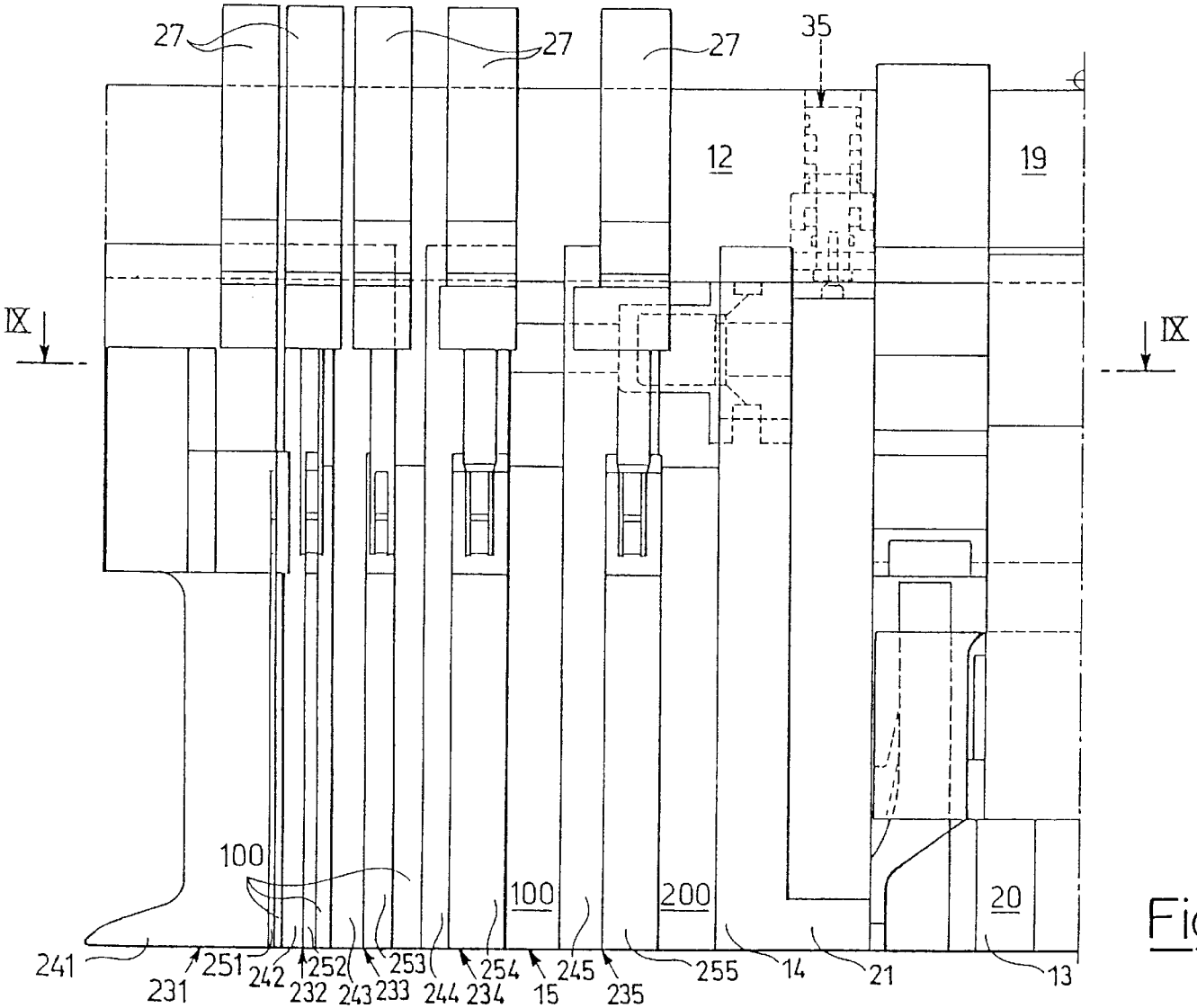
FIG. 3 is a front view in an enlarged scale of one half of a centre segment, of an expansion segment and of a group of composition segments of the blank holder of FIG. 2.

The blank holder 6 comprises a left-hand half (half-tool), shown in FIG. 2 and a right-hand half, not shown, exactly symmetrical. The left-hand half of the blank holder 6 comprises, in turn, a central segment 13 that co-operates in the function of contraction of the blank holder during a bending cycle, an expansion segment 14 that causes the blank holder to expand during the bending cycle and a group 15 of composition segments 231, 232, 233, 234 and 235. In the case illustrated the groups 15, left and right, each comprise five composition segments. Each composition segment 231, 232, 233, 234 and 235 is formed by a main segment and by an auxiliary segment coupled together, 241 and 251; 242 and 252; 243 and 253; 244 and 254; 245 and 255, respectively (FIGS. 3 and 6–8), as will be illustrated later. The groups 15 of composition segments assume the thickness necessary to obtain the desired length of the blank holder, according to the instructions of a work program of the bending machine. The left-hand half of the blank holder 6 comprises, moreover, a group 16 of external blank holder segments 31, in a number suitable for completing the length of the blank holder up to a maximum desired value.

The segments 14, 241–245 and 31 are connected to a guide 12 by means of a dove-tail joint 110 (FIGS. 1, 6 and 8) so as to be able to slide along the guide 12. The guide 12, in turn, is fastened to a casing 11 displaceable vertically with respect to the chassis 1. With the blank holder segments 14, 231–235 and 31 there engages a clamping 17 that has the function of pressing the segments tightly one against the other and to keep them compact during the bending cycle. The clamping 17 comprises a hydraulic cylinder provided with a single-acting piston having a stem 18 integral with the guide 12.

All the segments 13, 14, 241–245, 251–255 and 31 have a lower end shaped essentially like a shoe and bent in a direction orthogonal to a bend of the metal sheet 8 being worked. This profile of the lower end, typical of blank holder tools, interferes as little as possible with the bends of the panel that have already been executed, compatibly with the rigidity required by a bending process.

The central segment 13 (FIGS. 3 and 4) consists of an upper portion 19 integral with the casing 11 and of a lower end 20 movable vertically on the part of a hydraulic cylinder, not shown, contained in the portion 19, so as to perform a preselected lifting stroke.

Figure 9:
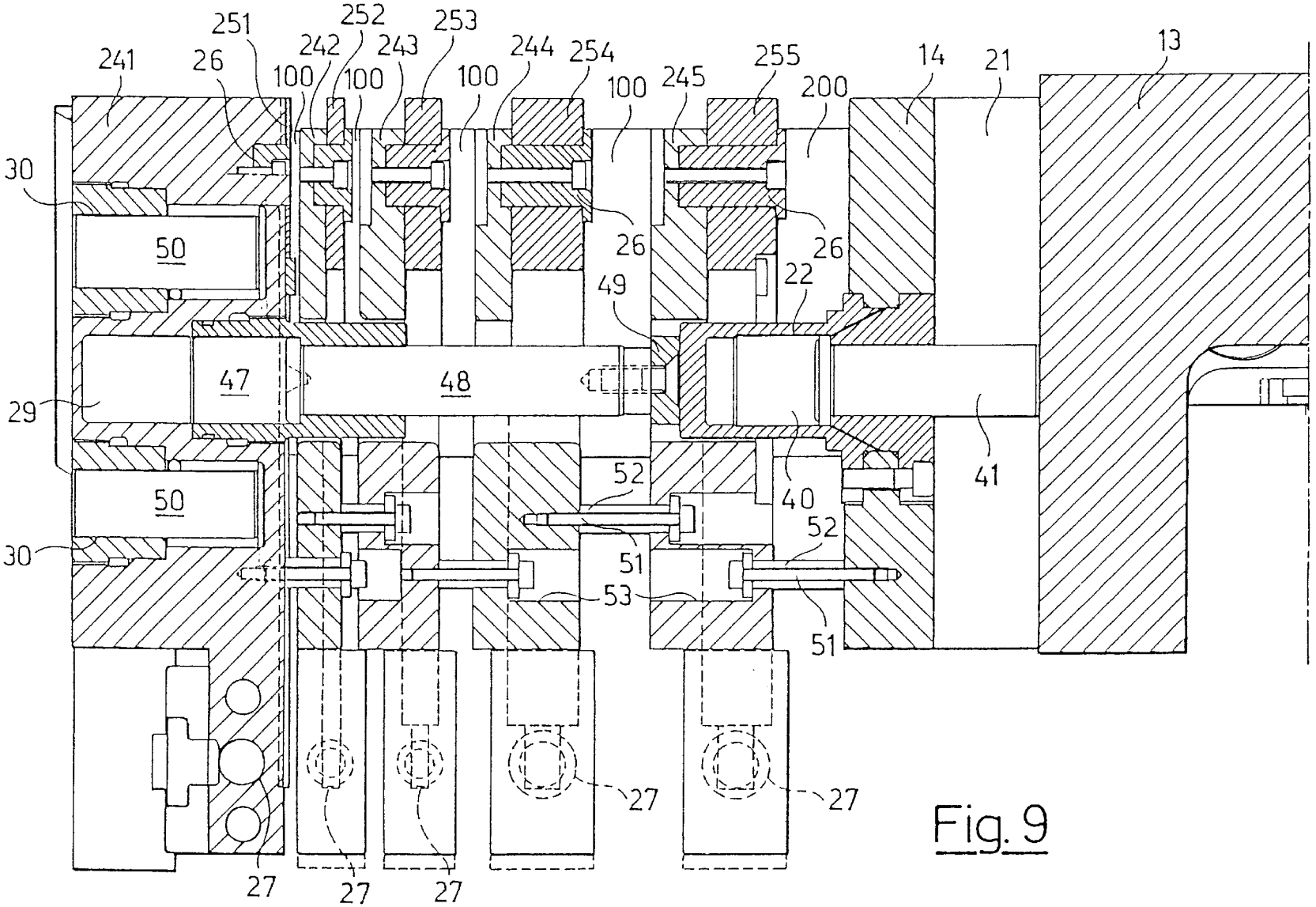
FIG. 9 is a cross-sectional view taken along the plane IX—IX of FIG. 3.

The expansion segment 14 (FIGS. 3 and 5) has a shoe-shaped lower end 21 protruding towards the centre of the machine, having a thickness that is slightly less than the lifting stroke of the lower end 20 of the central segment 13 and a length that is slightly greater than the contraction stroke executed by the left-hand side of the blank holder 6 during a bending cycle, as will be illustrated later. The expansion segment 14 incorporates a hydraulic cylinder 22 with a horizontal axis, parallel to the longitudinal axis of the blank holder 6, provided with a piston 40 having a stem 41 that rests up against the central segment 13 (FIG. 9). The cylinder 22 is capable of executing a stroke equal to that of contraction of the half-tool.

Figure 6:
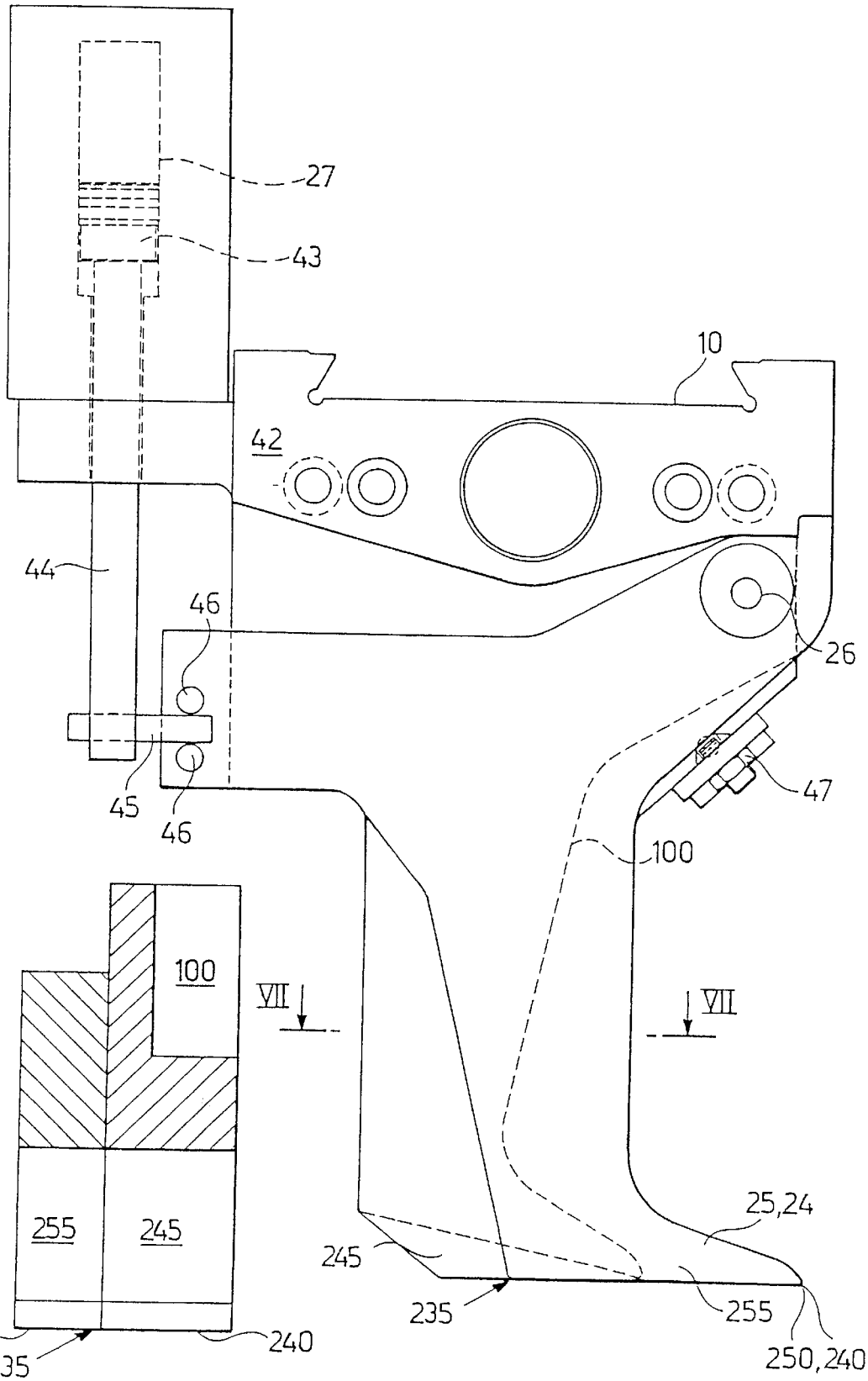
FIG. 6 is a right-hand side view, in an enlarged scale, of a composition segment of the group of FIG. 3 with an auxiliary segment thereof in the work condition.
Figure 7:
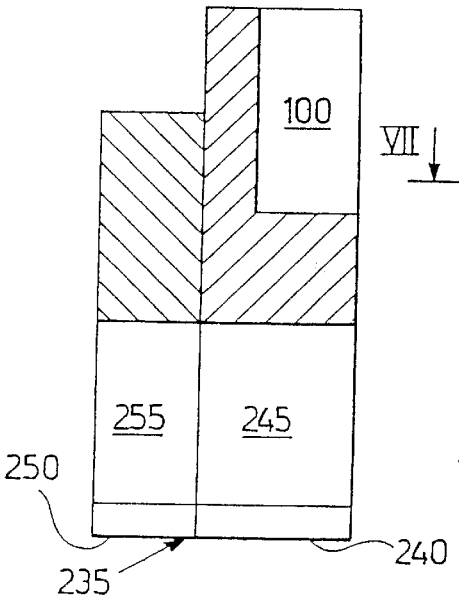
FIG. 7 is a cross-sectional view taken along the plane VII—VII of FIG. 6.
Figure 8:
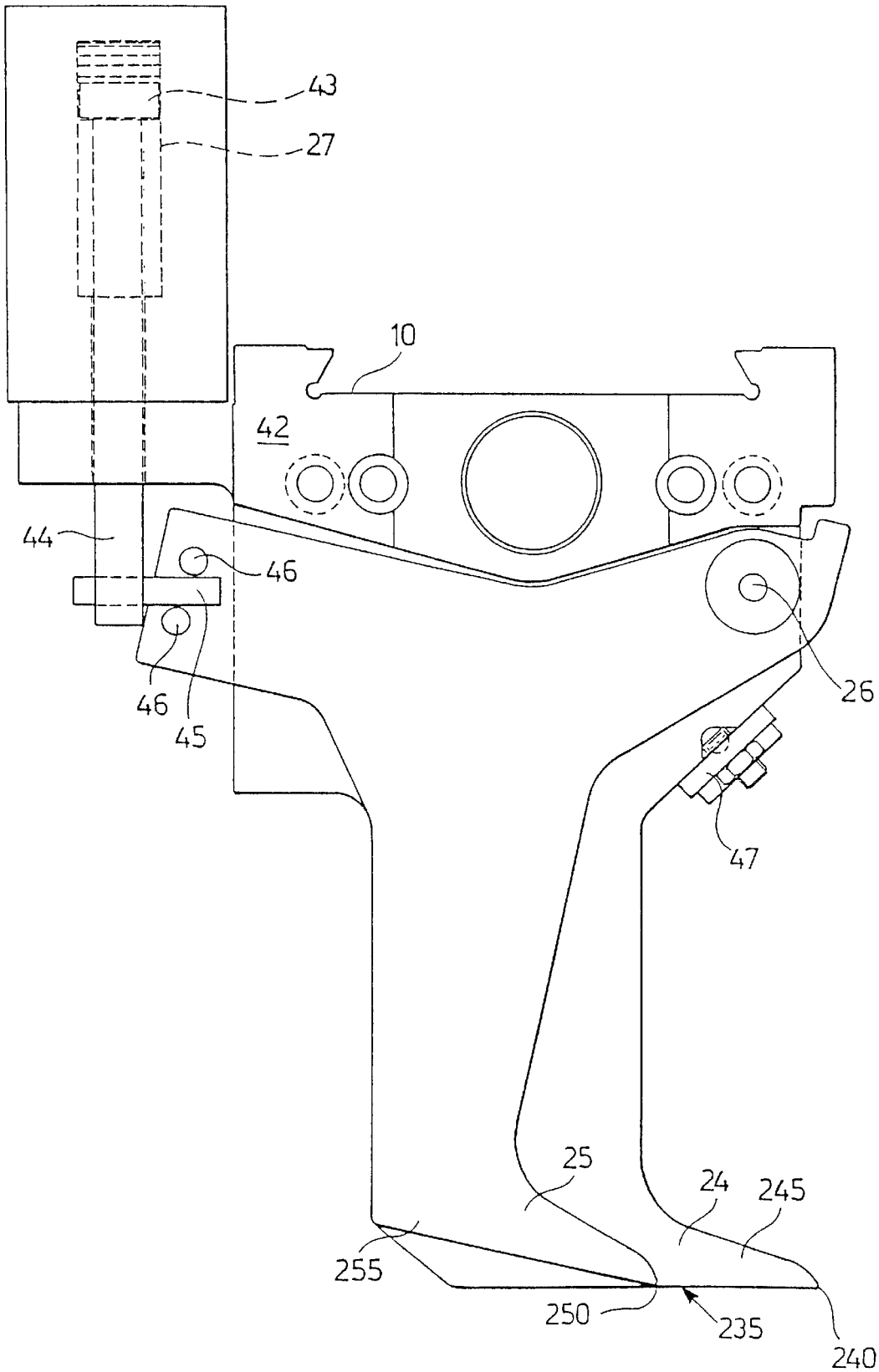
FIG. 8 is a view of the composition segment of FIG. 6 with its auxiliary segment in the at rest condition.

In the main segments 241–245, slidable along the guide 12, there are rotatably supported the auxiliary segments 251–255 by means of respective pivots 26 (FIGS. 6, 8 and 9). Each auxiliary segment, 251 or 252 or 253 or 254 or 255, is driven to rotate round the pivot 26 by a respective hydraulic cylinder 27 integral with an upper portion 42 of the main coupled segment, 241 or 242 or 243 or 244 or 245. Each cylinder 27 comprises a double-acting piston 43 provided with a stem 44 with which there is integral a finger-type rod 45 that engages with pins 46 fastened to the respective auxiliary segment 251–255 in order to drive it to rotate from a work position (FIG. 6) to an at rest position (FIG. 8) and vice versa.

Mechanical references 47, interposed between two coupled segments, 241 and 251 or 242 and 252, or 243 and 253 or 244 and 254 or 245 and 255, are adjusted so that, when an auxiliary segment is in the work condition (FIG. 6), an active edge thereof 24 is perfectly aligned with an active edge 25 of the main coupled segment, thus ensuring the good result of the bending operation. If, on the other hand, when an auxiliary segment is in the at rest condition (FIG. 8), it can penetrate into a cavity (impression) 100 sunk into one side of the main segment that is adjacent to it on the opposite side of the main coupled segment to which it is hinged. The auxiliary segments 251,252,253, 254 and 255 penetrate inside the cavity 100 of the main adjacent segments 242, 243, 244 and 245 and inside a cavity 200, respectively, of the contraction segment 14, adjacent to the auxiliary segment 255. In that way an auxiliary segment, with a simple rotation, assumes a position at rest into which it can penetrate and remain completely inside the cavity 100 of the main adjacent segment or in the cavity 200 of the expansion segment, when all the segments of the blank holder 6 are compacted by the clamping 17.

The main 241–251 and the auxiliary 251–255 segments also have lower ends, 24 and 25, respectively, shaped like a shoe. The main segment 241 (the first on the left of the composition group 15) has the lower end 24 shaped like a shoe that is also bent in a direction parallel to the bend of the metal sheet being worked (FIGS. 2 and 3) because it must leave room for the bends executed earlier on sides that are not parallel to the one being bent.

Calling module the minimum variation in the length of the blank holder 6 and indicating it with m, the auxiliary segments 251–255, rotating, have thicknesses multiples of the module m according to the equation $2^{(N-n)}$, where N is the maximum number of composition segments and n varies from N to 1. In the blank holder 6, the auxiliary segment 251 has thickness equal to m, the auxiliary segment 252 has thickness equal to 2 m, the auxiliary segment 253 has thickness equal to 4 m, the auxiliary segments 254 and 255 have thickness equal to 8 m. Thus, in this case, the auxiliary segment 255 has a thickness equal to $2^3$ m=8 m, less than the maximum value, equal to $2^4$ m=16 m, that it can assume on the basis of the equation given earlier.

The main segment 241 incorporates a hydraulic separator cylinder 29 (FIG. 9) with a horizontal axis having a piston 47 provided with a stem 48 that passes through all the segments of the composition group 15 and rests up against the cylinder 22 by means of a spacer 49. The main segment 241 also incorporates spacer cylinders 30 each provided with a piston 50, whose function will be illustrated later.

The main segments 241–245 are held together by means of threaded pivots 51 and bushes 52, slidable in seats 53.

Each external blank holder segment 31 incorporates two spacer cylinders 32 (FIGS. 10–12), each provided with a stem protruding toward the right, and a spacer cylinder 33, provided with a stem 56 protruding toward the left, that have the function of creating a free space between two adjoining segments 31. Two external adjacent segments 31 have respective stems directed in opposite directions: a segment 31 on the left has the stems 55 directed toward the right and the stem 56 directed toward the left, while the segment 31 on its right has the respective stems 55 and 56 directed in the opposite direction, toward the left and toward the right, respectively. This allows the segments 31 to be moved away one from the other by an amount greater than that allowed by the stroke of the stems 55 and 56 immersed in the thickness of an individual segment 31.

The lower end 57 of the external segments 31 that comes into contact with the metal sheet has the same shape, substantially bent like a shoe both in a direction orthogonal and in a direction parallel to the bend, similar to that of the main segment 241.

The external segments 31 all have the same thickness, with a value equal to a multiple of m, at most $2^N$ m. In the example illustrated in FIGS. 2, 10–12, the thickness of the external segments 31 is equal to $(2^{N-1}+2^{N-2})$m, the maximum thickness of the auxiliary segments 254 and 255 being equal to half the maximum value compatible with the number N (5) of the composition segments 231–235.

In the guide 12 between the central segment 13 and the expansion segment 14 there is a bolt-like safety device 35 (FIGS. 2, 3, 13 and 14) comprising a hydraulic cylinder 36 incorporated in the guide 12, having a piston 58 provided with a stem 59 with which there is integral a block 37 with a substantially parallelepiped-like shape. The block 37 is driven by the cylinder 36 to vertically slide in a slot 39 obtained in the guide 12 against the action of springs 38. The springs 38 urge the block 37 out of the slot 39. The block 37 is normally inserted between the segment 13 and the segment 14 under the action of the springs 38, and is disengaged by the cylinder 36 each time the blank holder 6 is to be contracted.

The safety device 35 has the function of creating an upper limit for the expansion segment 14. In fact, the segment 14 is guided in the guide 12 by means of a very short dove-tail joint 10, it rests up against the central segment 13 only by means of the lower end 21 and is urged by the clamping 17 that is at the opposite end of the half-tool; if there were no upper limit the dove-tail joint 10 would be stressed in an unbearable manner and it would be damaged.

A control unit and a distributor, not shown, control the operation of the hydraulic cylinders described earlier according to the programmed work sequences that have to be executed by the bending machine object of the present invention.

The operation of the bending machine is described hereafter.

At the end of a production cycle, the blank holder 6 is in the condition wherein the central segment 13 is raised, the safety device 35 is not inserted, the expansion cylinder 22 is contracted, the expansion segment 14 is close to the central segment 13, some of the auxiliary segments are rotated in the work position, while others are in the at rest position, two external segments 31 are spaced out and all the other external segments 31 are kept in adherence one with the other by the clamping 17.

The set-up of the left-hand half-tool of the blank holder 6 for the production of a panel having sides with a length different from those of a panel produced earlier is made with the sequence of movements described hereafter. The set-up of the right-hand half-tool of the blank holder 6 is symmetrical.

The spacer cylinders 32 and 33 of the external segments 31 are disactivated and the clamping 17 undoes the spacing between the same external segments 31. The separator cylinder 29 expands and extends as much as possible the group 15 of the composition segments 231–235. A preselected number of auxiliary segments 251–255 is driven by the respective cylinders 27 to move to the work position, so that the length of the blank holder 6, at the end of the set-up step, is equal to the desired one. Then, the separator cylinder 29 contracts.

The spacer cylinders of a series of external segments 31, two opposite pairs 32 or two opposite individual cylinders 33, expand and the clamping 17 also expands, bringing all the segments closer together, except for the external segments spaced out by the activated spacer cylinders, that exert a force greater than that of the clamping 17.

At this point the blank holder 6 is ready for the production of panels having bent edges.

During the bending cycle, at the instant when the blank holder 6 has to contract in order to leave the bent panel, the lower end 20 of the central segment 13 moves up, the safety device 35 rises, the expansion cylinder 22 of the segment 4, that exerts a force greater than that of the clamping 17, stops pushing and contracts. In this way the clamping 17 is capable of displacing all the segments up against the central segment 13 because now the lower end 21 of the expansion segment 14 can slide in under the central segment 13.

If the long sides of the panel have to be bent before the short sides, a second series of spacer cylinders 32 or 33 is activated during the passage from the bending of the long sides to the bending of the short sides, while the clamping 17 is simultaneously disactivated.

I claim:

1. A bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by a vertically displaceable guide, characterized in that said blank holder also comprises blank holder composition segments each formed by a main slidable segment and by an auxiliary segment coupled together, said auxiliary segment being movably supported by said main segment and being operatively connected to an actuator capable of displacing it from a work position, wherein an active edge thereof is aligned with an active edge of said main segment, to an at rest position wherein said active edge of said auxiliary segment is capable of penetrating entirely inside a cavity obtained in one side of a segment that is adjacent to it on the opposite side of said main coupled segment.

2. A bending machine according to claim 1, characterized in that said main segment is slidably supported by said guide.

3. A bending machine according to claim 1, characterized in that said auxiliary segment is rotatably supported by said main coupled segment by a pivot and is driven by said actuator to perform a rotatory movement from said work position to an at rest position wherein it is placed side-by-side with said cavity and vice versa, said auxiliary segment generating in said cavity of said adjacent segment when it is in said at rest position following an action of compression of said first segments and of said composition segments exerted by clamping.

4. A bending machine according to claim 1, characterized in that said cavity is obtained in one side of an adjacent main segment.

5. A bending machine according to claim 1, characterized in that said blank holder also comprises slidable blank holder expansion segments, each provided with a cavity capable of containing an auxiliary segment of an adjacent composition segment.

6. A bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by a vertically displaceable guide, said blank holder also comprising blank holder composition segments each formed by a main slidable segment and by an auxiliary segment coupled together, said auxiliary segment being movably supported by said main segment and being operatively connected to an actuator capable of displacing it from a work position, wherein an active edge thereof is aligned with continuity with an active edge of said main segment, to an at rest position wherein said auxiliary segment is capable of penetrating inside a cavity obtained in one side of a segment that is adjacent to it on the opposite side of said main coupled segment, and wherein said first blank holder segments, said composition segments and said expansion segments are slidably supported by said guide by dove-tail joints.

7. A bending machine according to claim 6, characterized in that said first blank holder segments, said composition segments and said expansion segments are placed both to the right and to the left of a liftable central blank holder segment having a position fixed with respect to said first segments, to said composition segments and to said expansion segments.

8. A bending machine according to claim 7, characterized in that between an expansion segment and said central segment an expansion cylinder is placed which is capable of bringing them near and moving them away so as to contract and expand said blank holder.

9. A bending machine according to claim 6, characterized in that a safety device is mounted in said guide between said central segment and an expansion segment, said safety device comprising a substantially parallelepiped-shaped block driven to vertically slide in a slot obtained in said guide by a hydraulic cylinder against the action of spring, said block being normally inserted between said central segment and said expansion segment under the thrust of said spring and being disengaged by said cylinder each time said blank holder is contracted.

10. A bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by a vertically displaceable guide, said blank holder also comprising blank holder composition segments each formed by a main slidable segment and by an auxiliary segment coupled together, said auxiliary segment being movably supported by said main segment and being operatively connected to an actuator capable of displacing it from a work position, wherein an active edge thereof is aligned with continuity with an active edge of said main segment, to an at rest position wherein said auxiliary segment is capable of penetrating inside a cavity obtained in one side of a segment that is adjacent to it on the opposite side of said main coupled segment, said auxiliary segment being rotatably supported by said main segment by a pivot and driven by said actuator to perform a rotatory movement from said work position to an at rest position wherein it is placed side-by-side with said cavity and vice versa, said auxiliary segment generating in said cavity of said adjacent segment when it is in said at rest position following an action of compression of said first segments and of said composition segments exerted by a clamp, and wherein said actuator comprises a double-acting hydraulic piston having a stem connected to a rod in engagement with pins integral with said auxiliary segment.

11. A bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by a vertically displaceable guide, said blank holder also comprising blank holder composition segments each formed by a main slidable segment and by an auxiliary segment coupled together, said auxiliary segment being movably supported by said main segment and being operatively connected to an actuator capable of displacing it from a work position, wherein an active edge thereof is aligned with continuity with an active edge of said main segment, to an at rest position wherein said auxiliary segment is capable of penetrating inside a cavity obtained in one side of a segment that is adjacent to it on the opposite side of said main coupled segment, and wherein in that between one main segment of a composition segment and an expansion segment a separator cylinder is placed which is capable of widening said composition segment.

12. A bending machine for the production of metal sheet panels having bent edges from metal sheets, comprising a fixed counterblade and a blank holder having programmable length, capable of clamping a metal sheet, and at least one bending blade capable of bending said edges, said blank holder comprising first blank holder segments slidably supported by a vertically displaceable guide, said blank holder also comprising blank holder composition segments each formed by a main slidable segment and by an auxiliary segment coupled together, said auxiliary segment being movably supported by said main segment and being operatively connected to an actuator capable of displacing it from a work position, wherein an active edge thereof is aligned with continuity with an active edge of said main segment, to an at rest position wherein said auxiliary segment is capable of penetrating inside a cavity obtained in one side of a segment that is adjacent to it on the opposite side of said main coupled segment, and wherein between said first blank holder segments spacer cylinders are placed which are capable of reciprocating the first blank holder segments.

* * * * *